US005092104A

United States Patent [19]

Zelenka

[11] Patent Number: 5,092,104

[45] Date of Patent: Mar. 3, 1992

[54] UNIVERSAL BAG SPREADER APPARATUS

[76] Inventor: Stanley R. Zelenka, 5202 E. 69th St., Hutchinson, Kans. 67502

[21] Appl. No.: 713,811

[22] Filed: Jun. 12, 1991

[51] Int. Cl.[5] ..... B65B 61/00

[52] U.S. Cl. ..... 53/167; 53/512; 53/375.4

[58] Field of Search ..... 53/167, 289, 393, 512, 53/481, 370.9, 371.3, 373.2, 373.7, 373.9, 375.4; 415/126, 206

[56] References Cited

U.S. PATENT DOCUMENTS

| | | | |
|---|---|---|---|
| 3,019,583 | 2/1962 | Sylvester et al. | 53/374.4 |
| 3,163,969 | 1/1965 | Irwin et al. | 53/481 X |
| 3,201,915 | 8/1965 | Yanulaitis | 53/377.2 |
| 3,286,433 | 11/1966 | Johnson et al. | 53/373.9 X |
| 3,562,920 | 2/1971 | Vuilleumier et al. | 53/370.9 X |
| 3,914,917 | 10/1975 | Young | 53/512 X |
| 4,858,416 | 8/1989 | Monaghan | 53/374.4 X |

*Primary Examiner*—Robert L. Spruill
*Assistant Examiner*—Daniel B. Moon
*Attorney, Agent, or Firm*—Phillip A. Rein

[57] ABSTRACT

This invention is a universal bag spreader apparatus utilized to prepare a container member having a baked product therein in a proper condition prior to a bag closing operation. The universal bag spreader apparatus includes 1) a basic support assembly having a main blower and filter assembly connected thereto; 2) an adjustable air discharge assembly connected to the main blower and filter assembly; and 3) a main control assembly to control blower motor operation and air flow volume. The main flower and filter assembly include a power blower assembly operable to receive inlet air through an inlet air filter assembly. The adjustable air discharge assembly includes 1) a primary inlet assembly connected to the main blower and filter assembly to receive inlet air thereto; 2) an intermediate inlet assembly connected to the primary air inlet assembly; 3) a final discharge assembly connected to the intermediate inlet assembly being rotatable about vertical and inclined axes; and 4) an adjustable support arm assembly interconnected to the intermediate inlet assembly and the final discharge assembly having features of infinite adjustability.

20 Claims, 4 Drawing Sheets

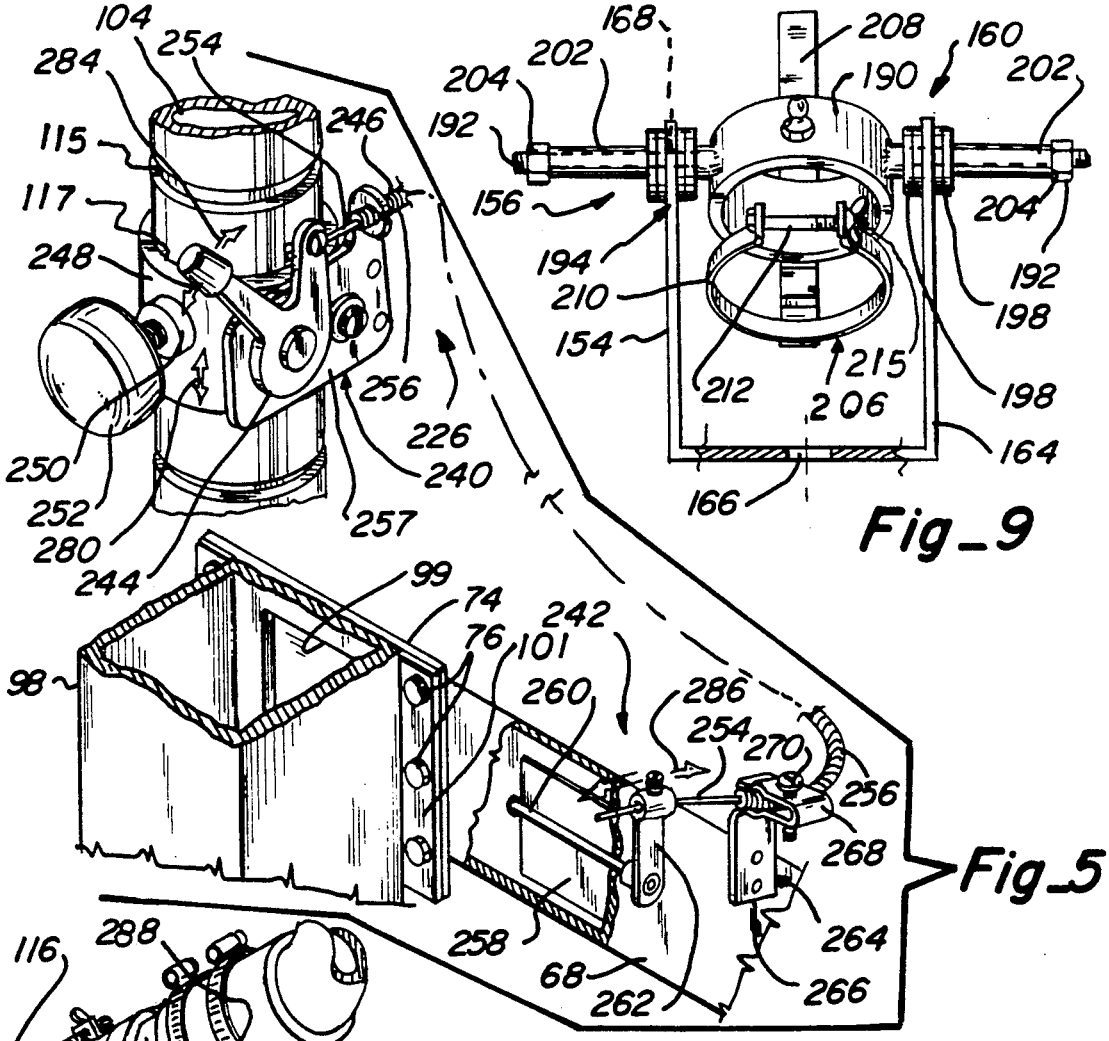
Fig_9
Fig_5
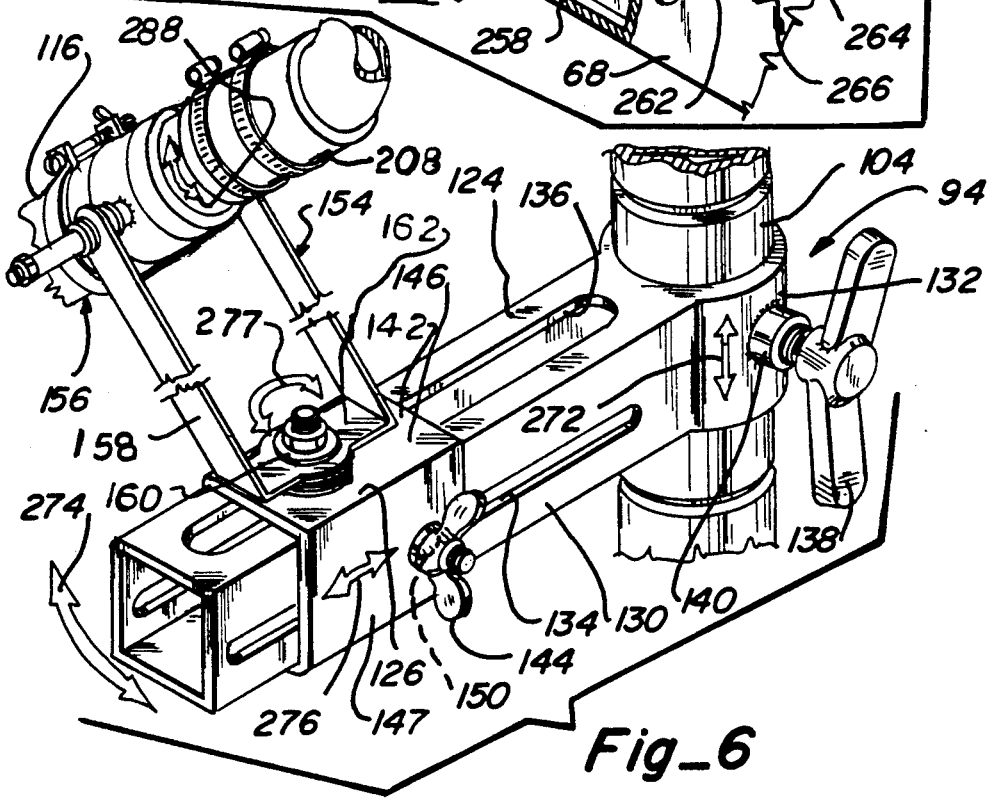
Fig_6

186
116
195
196
190
191
193
188
218
216
214
220
217
219
290
119
118
288
111
156
212
210
208
184
168
164
174
149
148
142
130
158
180
154
178
176
162
160
172
170
114

UNIVERSAL BAG SPREADER APPARATUS

BACKGROUND OF THE INVENTION

In the packaging industry, particularly but not exclusively in the area of the bagging of baked products such as buns, there is a problem of the bagged food product not being fully clipped or tied during a bag closing operation. What happens is that a portion of the open end of the bagged food product has been left unsealed.

The primary reason for this problem is that the open end of the bagged food product has not been put into a form that is most conducive to closing before the bagged food product enters into a bag closing machine.

Present methods being used to prepare the bagged food product before the bag closing operation are 1) to use a squirrel cage blower positioned above the bagged food product forcing air onto the open end thereof to force an open end of the bag downward before the bagged food product enters into the bag closing machine; 2) manually pulling an open end of the bag down and out by a manual hand operation; and 3) using a suction device to pull an open end of the bag down and out.

These methods have failed to solve the problem because they do not fully spread the open end of the bag and flatten it. By spreading the open end of the bag and flattening it, the open bag end is reduced to its minimum mass. This is particularly important whenever the bagged food product is being clipped by the bag closing machine. A connector hole in a clip is only so big and if the open bag end is folded back on itself, the connector hole in the clip cannot accept this increased bulk. A portion of the open bag end will then be left outside of the connector hole in the clip. This works much in the way that, if clothing is neatly folded and smoothed out, a suitcase can more easily accept the clothes.

Another reason that the bagged food product is not fully closed is that the open bag end has not been spread to its full length before it enters into the bag closing machine. The open bag end is of irregular shape and a portion of the open bag end will be left outside of the clipped or tied end.

Another reason that the open bag end has not been fully closed is that the open bag end has been hit with too much air forcing it downward too much and making the open bag end drag before it enters into the bag closing machine.

The squirrel cage blower method does not 1) provide adequate adjustments for positioning an air flow for diverse sizes of food product bags; and 2 provide for variation of air volume to deal with different densities of bag material being used. A food product bag which is more dense would require a higher volume of air to force the open bag end down than would a less dense bag material. If a bag material of low density were hit with a high volume of air, the open bag end would drag before entering the bag closing machine.

The manual and suction methods do not adequately achieve the desired form of the open bag end before entering the bag closing machine.

These prior art methods, while not adequately solving the primary problem, create a secondary problem being that the closed bag end, or tail as it is referred to in the industry, snags on conveyor belts used in baked goods production systems on a continuous conveyor assembly. This snagging is caused by the tail protruding downward whereby it is frequently caught by the conveyor belt.

This prior art problem is solved by the open bag end being in a spread and flattened form when it enters into the bag closing machine. After the bagged food product leaves the bag closing machine, the tail of the bagged package will be in a generally horizontal position. This greatly decreases the chances of it being caught in the conveyor belt and, thereby, resulting in damage or loss of the food product.

An additional problem that is not associated with bag closing but which should be solved prior to bag closing is that of excess air in the finished bagged product. A finished bagged product with excess air is difficult to fit into shipping containers and this can result in food product damage or loss. This excess air problem can be solved by expelling air out of the bagged food product by means of air forced onto the top of the bagged food product which forces air out of an open bag end.

It is noted that tearing of the open bag end by the bag closing machine would be greatly reduced by putting the open end of the bag into a spread and flattened form prior to entry into the bag closing machine.

PREFERRED EMBODIMENT OF THE INVENTION

In one preferred embodiment of this invention, a universal bag spreader apparatus is utilized with a baked goods production system consisting of 1) a baking and packaging assembly; 2) a continuous conveyor assembly to carry baked food products such as baked buns placed within a container member; 3) utilizing the universal bag spreader apparatus of this invention to contact the container member to place in a proper position for subsequent packaging steps; 4) a bag preparation brush assembly operable to contact an outer open end portion of the container member; and 5) a bag closing assembly to contact and secure an outer flattened portion of the container member with a clip or tie member which is standard procedure in baked goods production systems.

The universal bag spreader apparatus includes 1) a basic support assembly adapted to be mounted on a support surface; 2) a main blower and filter assembly mounted on the basic support assembly; 3) an adjustable air discharge assembly connected to the main blower and filter assembly to receive air flow therefrom for discharge at an adjusted proper location relative to a container member on the continuous conveyor assembly of the baked goods production system; and 4) a main control assembly operably connected to a) an adjustable air discharge assembly to regulate air flow; and b) a power control assembly to provide power to the main blower and filter assembly.

The main blower and filter assembly includes a power blower assembly operable to receive air from an inlet air filter assembly.

The power blower assembly includes a main support assembly secured to the basic support assembly and having mounted thereon a motor and blower assembly. The motor and blower assembly includes a drive motor member operable to drive an output drive shaft connected to a main blower assembly.

The main blower assembly includes a paddle wheel assembly mounted within a main blower housing in order to receive inlet air from the inlet air filter assembly and direct same for discharge through the adjustable air discharge assembly.

The inlet air filter assembly includes an air filter housing including one side discharging air therefrom and three open sides having air filter members therein to receive a large quantity of inlet air for cleansing before discharge to the adjustable air discharge assembly.

The adjustable air discharge assembly includes 1) a primary air inlet assembly to receive inlet air from the inlet air filter assembly; 2) an intermediate inlet assembly to receive and direct air vertically from the primary air assembly; 3) a final discharge assembly pivotally connected to an upper end of the intermediate assembly having a flexible hose member with a discharge nozzle assembly at an outer end thereof; and 4) an adjustable support arm assembly interconnected to the intermediate inlet assembly and the final discharge assembly to provide vertical and lateral support plus numerous adjustable features.

The adjustable support arm assembly includes 1) a horizontal support arm assembly having one end vertically and rotatably adjustably adjusted to the intermediate inlet air assembly; 2) a yoke support bracket assembly connected to the horizontal support arm assembly; and 3) a support discharge tube assembly rotatably connected to the yoke support bracket assembly and connected to the final discharge assembly.

The yoke support bracket assembly is movable axially on the horizontal support arm assembly to provide horizontal adjustment relative to a vertical tube member of the intermediate inlet assembly.

The support discharge tube member includes 1) a pivot yoke assembly rotatably connected to the yoke support bracket assembly; and 2) a discharge tube pivot support and brake assembly connected to the pivot yoke assembly and the final discharge assembly.

The pivot yoke assembly includes a U-shaped main yoke member rotatably connected to the yoke support bracket assembly by a yoke connector assembly for movement about a vertical axis. The yoke connector assembly operates to firmly hold the main yoke member in a selected, adjusted position.

The discharge tube pivot support and brake assembly includes 1) a tube pivot support assembly connected to an outer upper end of the main yoke member and a discharge tube member of the final discharge assembly; 2) a tube brake assembly connected to the tube pivot support assembly and operably connected to the discharge tube member; and 3) an air tube connector assembly to connect the tube pivot support assembly to the discharge tube member to permit relative rotational movement.

The tube pivot support assembly includes 1) a main bearing member mounted about the discharge tube member to permit rotation thereof; 2) spaced axially aligned support handle members connected to the main bearing member and the main yoke member to control pivotal movement of the discharge tube member; 3) a handle connector assembly operable to hold the main bearing member and connected handle members in a pivotal adjusted position about a horizontal axis; and 4) stop collar members mounted on each side of the main bearing member and secured to the discharge tube member to prevent lateral movement of the discharge tube member.

The tube brake assembly operates to hold the discharge tube member in a rotational adjusted position about its longitudinal axis.

The air tube connector assembly connects an upper end of the discharge tube member to an elbow member which is connected to a swivel elbow member of the final discharge assembly.

The main control assembly includes a power control assembly and an air flow control assembly. The power control assembly includes a control housing supplied with power through an inlet power cord and having control members thereon. The control members include 1) an on/off switch; 2) a safety fuse connected to the inlet power cord; and 3) a pilot light to indicate that electrical power is supplied to the main blower and filter assembly.

The air flow control assembly includes a cable and handle assembly having a cable support bracket secured to the intermediate inlet assembly and a butterfly valve assembly connected to the discharge tube member on the main blower assembly. The cable and handle assembly is provided with a handle member connected by a cable member to the butterfly valve assembly.

The butterfly valve assembly includes a baffle member operable to be rotated about a pivot shaft to control air flow through the discharge tube member of the main blower assembly.

Therefore, it is seen that the main control assembly operates to 1) supply the electrical power and controls of the motor and blower assembly; and 2) control volume of air flow into the adjustable air discharge assembly for proper operation of this invention.

OBJECTS OF THE INVENTION

One object of this invention is to provide a universal bag spreader apparatus utilizing air flow for spreading and flattening an outer open end of a container member, such as a plastic bag, containing food product therein prior to a subsequent packaging and shipping operation.

Another object of this invention is to provide a universal bag spreader apparatus operable to utilize air flow with sufficient pressure and volume to expel a portion of air contained within a container member having a baked product therein for trouble free subsequent packaging operations.

One other object of this invention is to provide a universal bag spreader apparatus including a main blower and filter assembly to provide proper air pressure and volume flow through an adjustable air discharge assembly having a discharge nozzle to be moved to an infinite number of adjusted positions for required air discharges.

One further object of this invention is to provide a universal bag spreader apparatus including a main blower and filter assembly utilizing a power blower assembly with a paddle wheel blower structure to create a large volume of air flow and operable to receive air through an air filter assembly having a large area of filtering surface so that the air is thoroughly cleansed before being directed to the container member having a baked food product therein for health and sanitary reasons.

An additional object of this invention is to provide a universal bag spreader apparatus used in a baked goods production system including an adjustable air discharge assembly having a final discharge assembly connected to an adjustable support arm assembly so that a discharge nozzle can be adjusted vertically, horizontally, rotatably, and angularly to achieve all goals and requirements in an operation of flattening and closing an outer open end of the container member having a baked food product therein regardless of the type, size, and material of the container member or size and type of the machinery used in the baked goods production system.

Still, one other object of this invention is to provide a universal bag spreader apparatus which is compact in size; readily assembled and disassembled for maintenance purposes; fully adjustable for moving an air flow discharge nozzle to any desired height and location for use with a baked goods production system; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

FIG. 5 is a fragmentary exploded perspective view illustrating interconnection of an air flow control assembly of this invention;

FIG. 6 is a fragmentary perspective view illustrating a support discharge tube assembly of this invention;

FIG. 9 is a front elevational view of a tube pivot support assembly and interconnected tube brake assembly having portions broken away for clarity.

Figure 1:
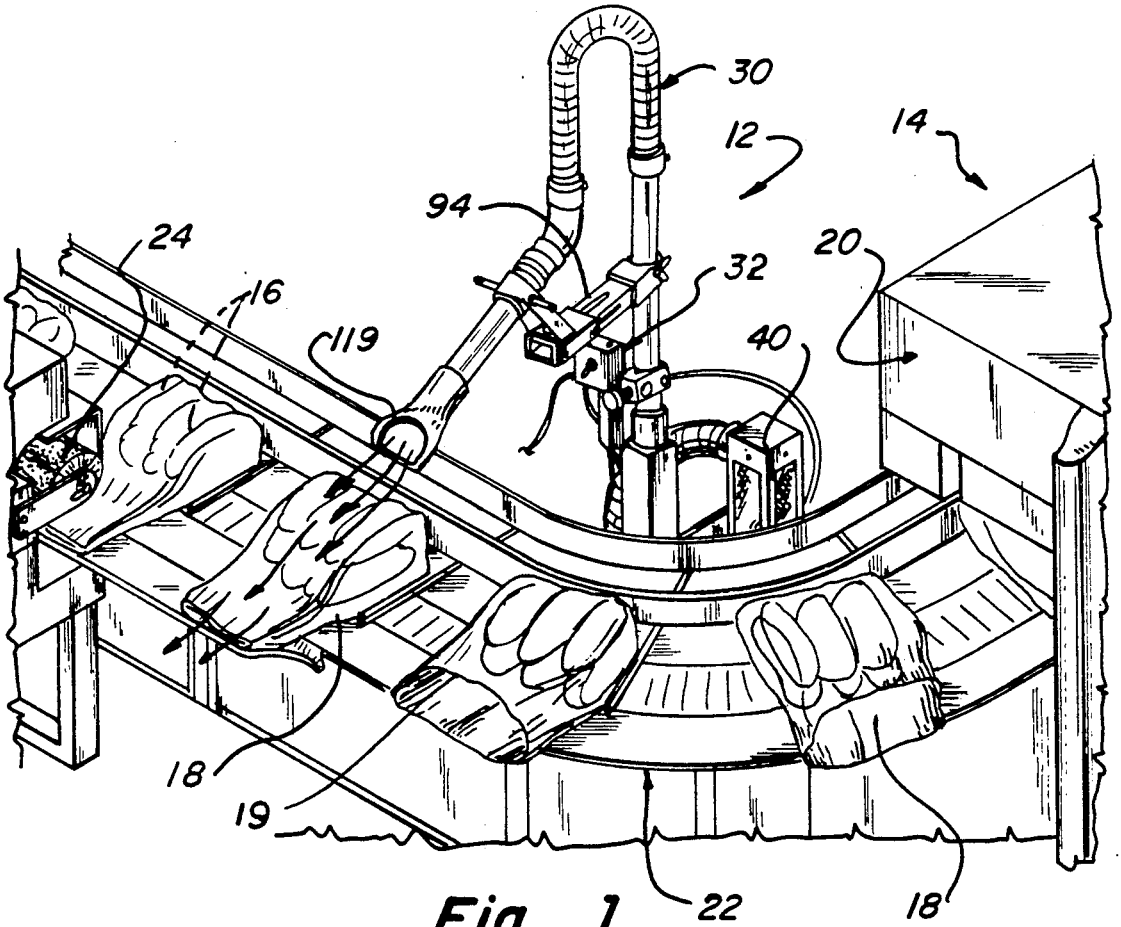
FIG. 1 is a perspective view of the universal bag spreader apparatus of this invention as utilized in a baked goods production system.
Figure 2:
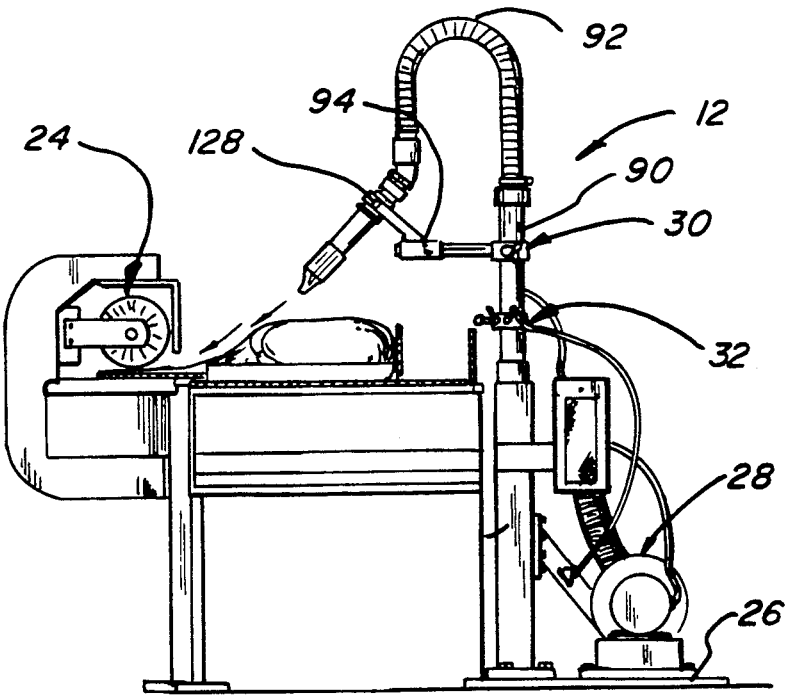
FIG. 2 is a side elevational view of the universal bag spreader apparatus as utilized with the baked goods production system.
Figure 3:
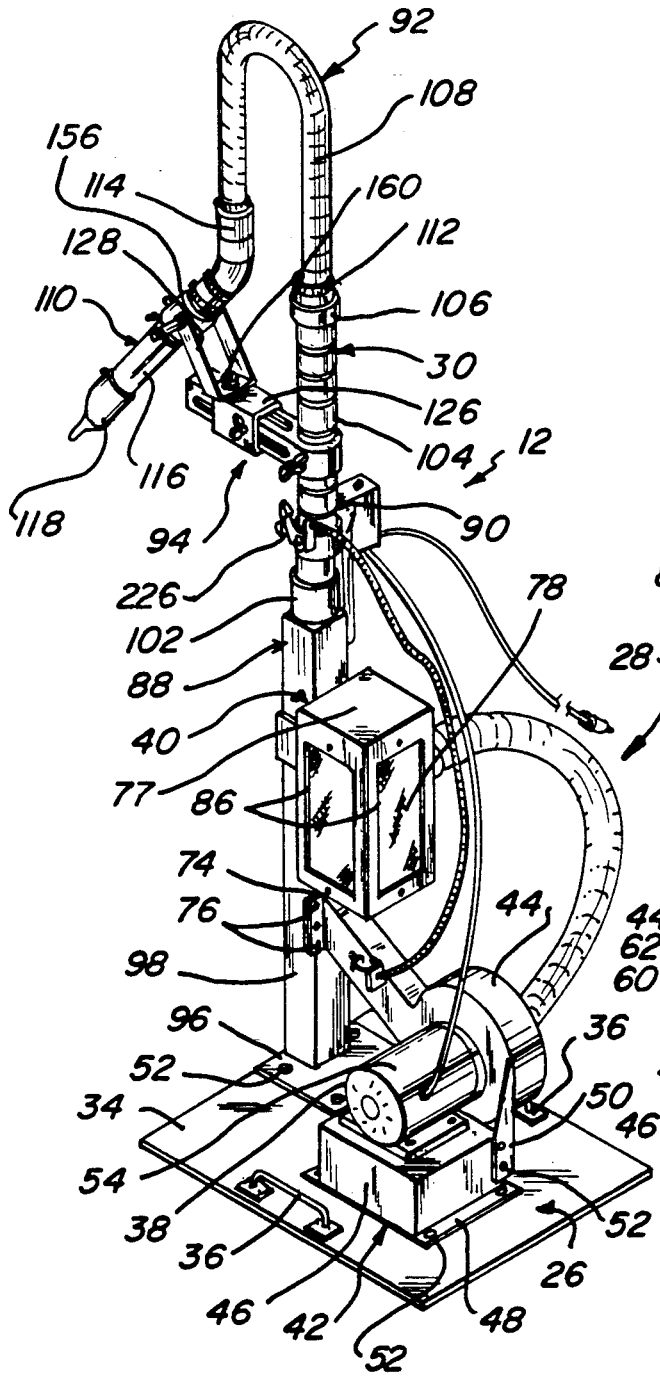
FIG. 3 is a perspective view of one side of the universal bag spreader apparatus.
Figure 4:
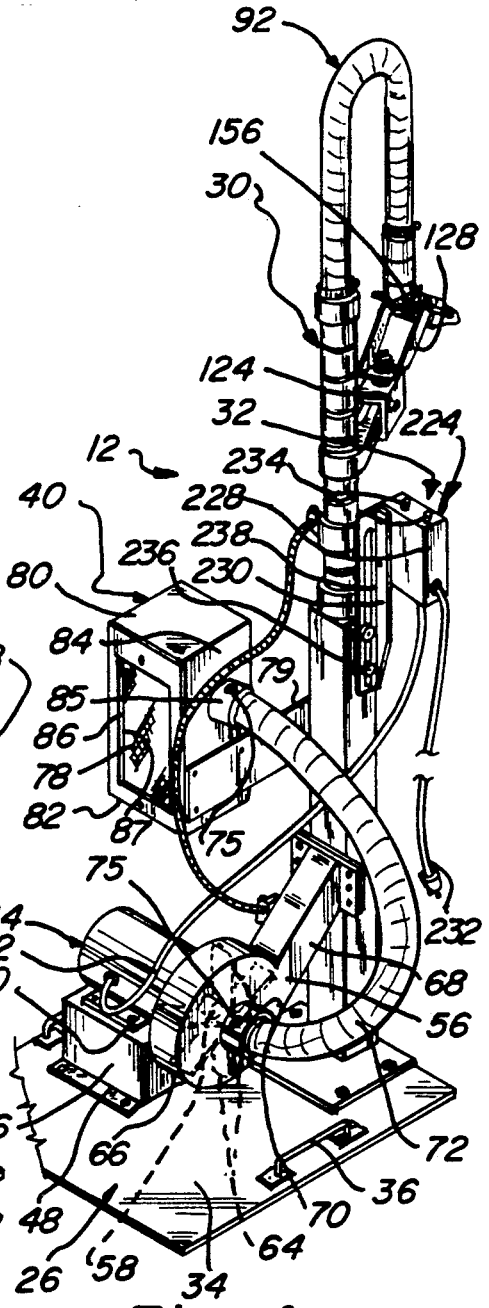
FIG. 4 is a perspective view similar to FIG. 3 showing an opposite side of the universal bag spreader apparatus.

The following is a discussion and description of preferred specific embodiments of the universal bag spreader apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a universal bag spreader apparatus of this invention, indicated generally at 12, is utilized in conjunction with a baked goods production system 14. The baked goods production system 14 utilizes 1) a bakery and packing assembly 20 wherein a product, such as hamburger or hot dog buns, are baked to achieve a baked product 16 which is placed in a container member 18 that may consist of a clear plastic bag of various sizes, shapes, and thicknesses; 2) a continuous conveyor assembly 22 to convey the bag container member 18 enclosing the baked product 16 on a belt or roller conveyor structure; 3) a bag preparation brush assembly 24 operable to contact a flattened open end of the container member 18 during a process step; and 4) a bag closing assembly (not shown) which receives the flattened open end of the container member 18 for closing through the use of a plastic type clip member or a flexible tie member and the automatic bag closing assembly is well known in the prior art.

In use with the baked goods production system 14, the universal bag spreader apparatus 12 can be placed at various positions along the continuous conveyor assembly 22 to meet overall production and packaging requirements. As illustrated in FIG. 1, the universal bag spreader apparatus 12 is placed adjacent to the continuous conveyor assembly 22 after the bakery and packaging assembly 20 and before entering the bag preparation brush assembly 24 and the bag closing assembly.

The universal bag spreader apparatus 12 includes 1) a basic support assembly 26; 2) a main blower and filter assembly 28 mounted on the basic support assembly 26; 3) an adjustable air discharge assembly 30 secured to the basic support assembly 26 and operably connected to the main blower and filter assembly 28 to receive an air flow therefrom; and 4) a main control assembly 32 connected to the adjustable air discharge assembly 30 and to the main blower and filter assembly 28.

The basic support assembly 26 includes a main base plate member 34 preferrably constructed of a sturdy steel sheet material and having spaced handle members 36 thereon for ease of grasping, conveying, and moving to a desired operational location.

The main blower and filter assembly 28 include a power blower assembly 38 interconnected to an inlet air filter assembly 40. The power blower assembly 38 includes a main support assembly 42 connected to the main base plate member 34 and having a motor and blower assembly 44 mounted thereon.

The main support assembly 42 includes a support housing member 46 having anchor flanges 48 connected thereto and a blower support flange 50. The anchor flanges 48 are secured as by nut and bolt members 52 against a top surface of the main base plate member 34. The blower support flange 50 is secured as by nut and bolt members 52 to the support housing member 46.

The motor and blower assembly 44 includes a drive motor member 54 operably connected to a main blower assembly 56. The drive motor member 54 includes 1) an output drive shaft 58; 2) a motor support base 60 secured by nut and bolt members 52 to the top surface of the support housing member 46; and 3) a power supply cord 62 to provide the necessary electrical power source thereto.

The drive motor member 54 can be of a variable speed type motor controlled through a rheostat to increase and decrease the rotational speed of the output drive shaft 58 and, thus, the air flow velocity and volume received from the main blower assembly 56.

The main blower assembly 56 includes a paddle wheel assembly 64 mounted within a main blower housing 66 having a discharge tube member 68 connected thereto. The discharge tube member 68 is provided at an outer end with a connector flange 74 secured by anchor members 76 to the adjustable air discharge assembly 30.

The main blower housing 66 is provided with an air inlet hose flange 70 operable to receive one end of an inlet hose member 72 held thereon by screw members 75. The inlet hose member 72 is preferrably constructed of a flexible plastic and wire reinforced type.

The inlet air filter assembly 40 includes 1) an air filter housing 77; 2) a plurality of air filter members 78 connected to the air filter housing 77; and 3) a filter support bracket 79 interconnected between the air filter housing 77 and the adjustable air discharge assembly 30.

The air filter housing 77 is of a rectangular box shape having a top wall 80, a bottom wall 82, an air discharge wall 84, and air inlet walls 86. The air discharge wall 84 is provided with a hose connector flange 85 adapted to receive another end of the inlet hose member 72 and held thereon by screw members 75.

The air inlet walls 86 are each provided with a large rectangular opening 87 to receive respective ones of the air filter members 78 therein in a sealed engagement. This requires that all of the inlet air flows through the filter medium of the respective air filter members 78 on conveyance to the main blower assembly 56.

The air filter members 78 are provided with an outer metal screen to provide rigidity plus protection against tearing from foreign objects. The filter medium can be constructed of known types to provide any desired degree of particle size filtering and the air filter members 78 can be easily removed, cleansed, or replaced as required during periodic maintenance.

The adjustable air discharge assembly 30 includes 1) a primary inlet assembly 88 mounted on the main base plate member 34 of the basic support assembly 26; 2) an intermediate inlet assembly 90 connected to an upper discharge end of the primary inlet assembly 88; 3) a final discharge assembly 92 connected to an upper discharge end of the intermediate inlet assembly 90; and 4) an adjustable support arm assembly 94 connected to the intermediate inlet assembly 90 and to the final discharge assembly 92 to provide for multiple adjustment features thereof in a manner to be explained.

The primary inlet assembly 88 includes a base plate member 96 having connected and upwardly extended therefrom a conveyor tube member 98 which is of a square shape in traverse cross section. The base plate member 96 is secured as by nut and bolt members 52 to the main base plate member 34 of the base support assembly 26.

As noted in FIG. 5, the conveyor tube member 98 has an air inlet opening 99 surrounded by an anchor flange 101 aligned with a central opening to the discharge tube member 68 of the main blower assembly 56. The anchor members 76 are operable to provide a sealed interconnection between the connector flange 74 and the anchor flange 101.

The intermediate inlet assembly 90 includes 1) a connector collar 102 connected in a sealed manner to an upper end of the conveyor tube member 98; 2) a vertical tube member 104 connected to an upper portion of the connector collar 102; and 3) a top connector member 106 secured to the upper end of the vertical tube member 104 being of a rotatable 360 degree swivel type connector.

The final discharge assembly 92 includes 1) a flexible hose member 108 held as by clamp members 112 to the upper portion of the top connector member 106; and 2) a discharge nozzle assembly 110 interconnected to the outer end of the flexible hose member 108.

The discharge nozzle assembly 110 includes 1) an elbow member 114 being a rotatable 360 degree swivel type connector; 2) a discharge tube member 116 connected to the outer end of the elbow member 114; and 3) a discharge nozzle 118 connected to an outer end of the discharge tube member 116. The discharge tube member 116 rotates about its longitudinal axis but is held against axial movement as will be explained.

The vertical tube member 104 is provided with vertically spaced circumferential grooves 115 of square shape in transverse cross section spaced apart every two (2) inches and having indicator lines 117 placed equally between the grooves 115 for reasons to be explained.

The elbow member 114 includes a non-rotatable section 111 having approximately 135 degree angle turn to best operate with the adjustable support arm assembly 94 in a manner to be explained.

It is noted that the discharge nozzle 118 may be of various configurations having various sizes and shapes of discharge openings 119 therein such as a large opening shown in FIG. 1. A particular discharge nozzle 118 can be selected depending on the width and size of the container members 18 having the baked product 16 therein. Additionally, the size of the discharge nozzle 118 and its respective discharge opening 119 depends on the container member 18 and the density, strength, and thickness of the material from which the container member 18 has been constructed.

The adjustable support arm assembly 94 includes 1) a horizontal support arm assembly 124 connected at one end to the vertical tube member 104; 2) a yoke support bracket assembly 126 slidably and adjustably mounted on the horizontal support arm assembly 124; and 3) a support discharge tube assembly 128 connected to the yoke support bracket assembly 126 and the discharge tube member 116 of the discharge nozzle assembly 110 of the final discharge assembly 92.

The horizontal support arm assembly 124 includes a bracket member 130 having a support collar 132 at one end being of cylindrical shape which is mounted about the vertical tube member 104 of the intermediate inlet assembly 90 and held in a vertically and rotatably adjusted position thereon through the use of a wing bolt 138 mounted within a threaded lug member 140. An inner end of the wing bolt 138 is engagable with a respective one of the grooves 115 to securely hold the bracket member 130 in an adjusted position.

The bracket member 130 has side wall slots 134 in opposed aligned relationship and an upper wall slot 136. The side wall slots 134 and upper wall slot 136 are operable to receive portions of the pivot support arm assembly 126 therein in a manner to be explained.

The yoke support bracket assembly 126 includes an arm support tube member 142 placed about and telescopingly movable on the bracket member 130 of the horizontal support arm assembly 124.

The arm support tube member 142 is provided with a top wall 146 integral with opposed side walls 147. The top wall 146 includes a connector hole 148 to connect the support discharge tube assembly 128 thereto.

The side walls 147 are provided with opposed anchor holes 150 to receive a connector wing and nut bolt member 144 therein which is operable to secure the arm support tube member 142 in a given adjustable axial location along the length of the bracket member 130.

The support discharge tube assembly 128 includes a pivot yoke assembly 154 which is rotatably connected to the yoke support bracket assembly 126 and to the tube member 114 of the final discharge assembly 92. The pivot yoke assembly 154 includes a main yoke member 158 connected to the top wall 146 of the yoke support bracket assembly 126.

The main yoke member 158 is of generally U-shape having a base member 162 integral with inclined, parallel spaced support members 164. The base member 162 includes a connector hole 166 to receive a bolt member for connection to the arm support tube member 142.

Upper ends of the inclined support members 164 are provided with aligned yoke connector holes 168 for connection to the discharge tube pivot support and brake assembly 156 as will be described.

Figures 7, 8:
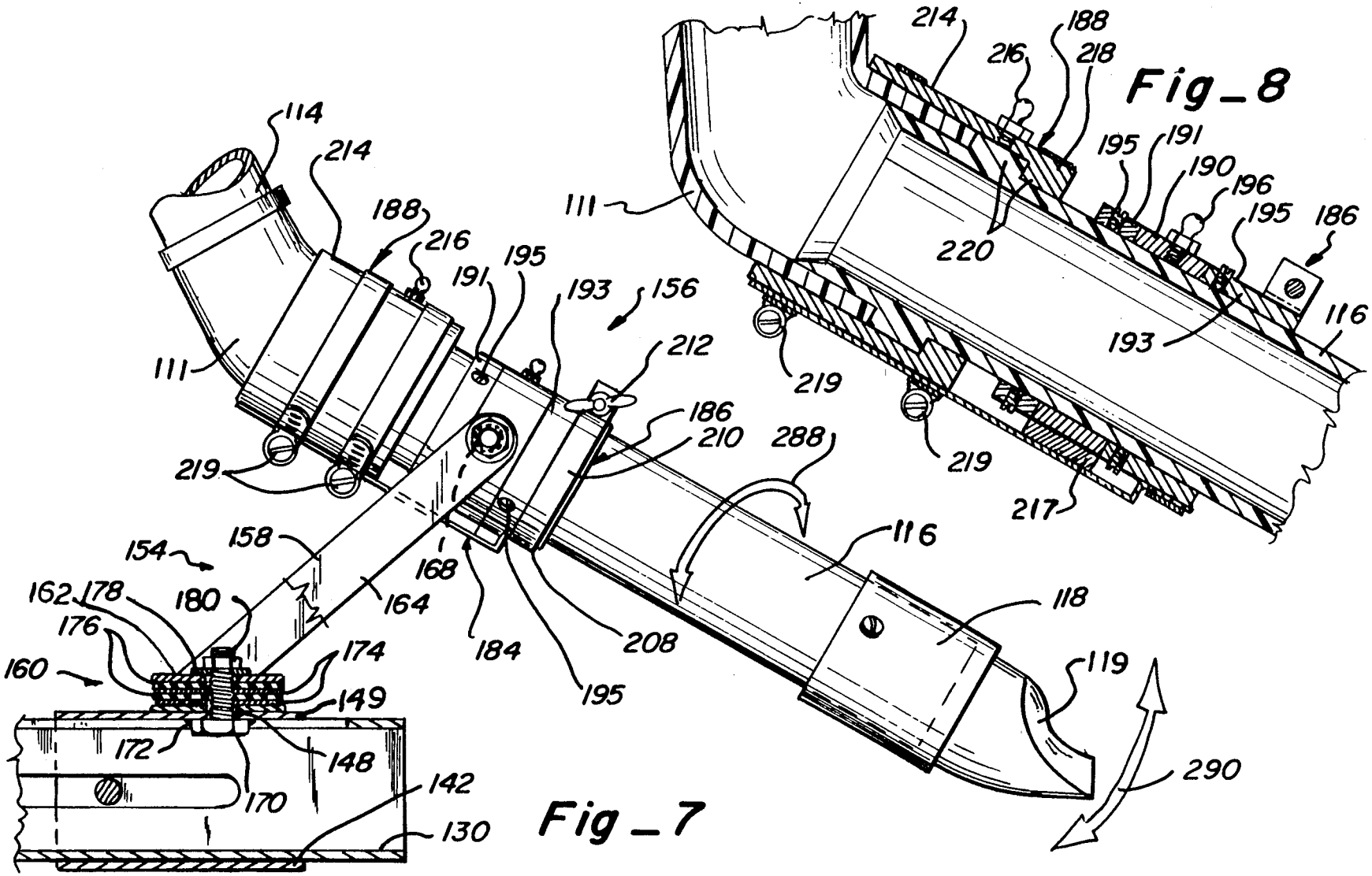
FIG. 7 is a fragmentary side elevational view of a final discharge assembly as connected to the support discharge tube assembly.
FIG. 8 is a fragmentary sectional view of a discharge tube pivot support and brake assembly of this invention.

As noted in FIG. 7, the yoke connector assembly 160 includes 1) a main support bolt 170 extended upwardly through the connector hole 148 in the arm support tube member 142; 2) a washer member 149 placed over the main support bolt 170 against a bolt head section 172 and welded to the top wall 146; 3) two washer members 174 separated by neoprene washers 176 are placed over the main support bolt 170; 4) the base member 162 is mounted with the connector hole 166 receiving the main support bolt 170 therethrough; and 5) a final washer member 178 and lock nut member 180 is placed on the upper end of the main support bolt member 170.

Adjacent surfaces of a head section of the main support bolt 170 and the washer member 149 are welded to the top wall 146 of the arm support tube member 142.

The lock nut member 180 is tightened on the secured rigid main support bolt 170 and a compression brake situation is achieved by the base member 162 being sandwiched between the washer member 178 and a neoprene washer 176.

This braking action allows the main yoke member 158 to be pivoted about a vertical axis and held in a given rotational position by the yoke connector assembly 160.

The discharge tube pivot support and brake assembly 156 includes 1) a tube pivot support assembly 184 rotatably connected to upper ends of support members 164 of the main yoke member 158; 2) a tube brake assembly 186 connected to the tube pivot support assembly 184 and mounted about the discharge tube member 116; and 3) an air tube connector assembly 188.

The tube pivot support assembly 184 includes 1) a main bearing member 190 mounted about the discharge tube member 116; 2) axially aligned threaded handle members 192 welded to the main bearing member 190; 3) a rear stop collar member 191 and a forward stop collar member 193 mounted about the discharge tube member 116 on respective opposite sides of the main bearing member 190; and 4) a handle connector assembly 194 connected to the threaded handle members 192.

The stop collar members 191, 193 are secured in position by one or more set screws 195. The main bearing member 190 has a grease zerk 196 to lubricate the rotatable discharge tube member 116.

As noted in FIG. 9, the handle connector assembly 194 includes 1) a plurality of steel washers 198; 2) tubular spacer members 202 mounted about respective ones of the support handle members 192; and 3) an adjustment nut member 204 connected to outer respective ends of the support handle members 192.

More specifically, two of the steel washers 198 are placed around the support members 164 on the respective support handle members 192 with the innermost ones welded to the support handle members 192 to act as stops for a clamping action. An additional two of the steel washers 198 are placed on the respective support handle members 192 between adjacent support members 164 and spacer members 202.

The adjustment nut members 204 are used to achieve the clamping action on the support members 164 and regulate the force needed to pivot the main bearing member 190 and interconnected discharge tube member 116 about a longitudinal axis of the support handle members 192.

As shown in FIG. 9, the tube brake assembly 186 includes a main brake member 206 secured as by welding to a connecting arm member 208. The main brake member 206 consists of a clamp ring 210 with outer spaced adjacent ends interconnected by a bolt member 212 having a wing nut 215 mounted on one end thereof.

A spacer member 217 is welded to an upper surface of the connecting arm member 208 and a lower surface of the main bearing member 190 in the assembled condition as noted in FIG. 8. This achieves the rigid connection with the air tube connector assembly 188.

As shown in FIG. 8, the air tube connector assembly 188 includes 1) a connector sleeve member 214 having a head section 218 mounted about abutting portions of the non-rotatable section 111 of the elbow member 114 and the discharge tube member 116; and 2) a pair of connector clamps 219 mounted about the connector sleeve member 214.

The connector sleeve member 214 is secured by adhesive to adjacent outer surfaces of the non-rotatable section 111 and further anchored by the connector clamps 219. A grease zerk 216 allows lubrication of the rotatable discharge tube member 116.

Adjacent ends of the connector sleeve member 214 and the discharge tube member 116 are provided with respective shoulder sections 220 which permits rotation of the discharge tube member 116 but not axial movement thereof.

The main control assembly 32 includes a power control assembly 224 to control an electrical power source; and 2) an air flow control assembly 226 to control the volume of air flow to the adjustable air discharge assembly 30.

The power control assembly 224 includes a control housing 228 mounted on a support bracket 230 having an inlet power cord 232 connected thereto to supply normally 110 volt AC power. Additionally, the control housing 228 has a plurality of control buttons 234 thereon which can control operations such as 1) "On" and "Off" power supply to the drive motor member 54; and 2) a variable motor speed control.

Inside the control housing 228 is contained a safety fuse member to protect the operation of the drive motor member 54 and a pilot light to indicate system energization.

The support bracket 230 is of an adjustable type connected to the control housing 228 having an adjustment slot 238 for connection by nut and bolt members 236 to an outer surface of the conveyance tube member 98 of the primary inlet assembly 88 which allows for vertical movement of the control housing 228.

The air flow control assembly 226 includes 1) a cable and handle assembly 240 connected to the vertical tube member 104 of the intermediate inlet assembly 90 and, at an opposite end, to a butterfly valve assembly 242.

As noted in FIG. 5, the cable and handle assembly 240 includes a handle member 244 connected to a cable member 246 with the handle member 244 rotatably mounted on a cable support bracket 257 and connected to a control support tube 248.

The control support tube 248 has a threaded connector lug 250 operable to receive an anchor bolt 252 therein for securing the entire cable support bracket 257 in an adjusted position on the vertical tube member 104.

The cable member 246 is of a conventional nature having an innermovable cable 254 mounted within an outer sleeve 256 which has one end anchored to the cable support bracket 257 and another end connected to the butterfly valve assembly 242.

The butterfly valve assembly 242 includes a baffle member 258 connected to a pivot shaft 260. The pivot shaft 260, as noted in FIG. 5, is connected to a cable connector 262 which is connected to the pivot shaft 260 through an outer surface of the discharge tube member 68 of the main blower assembly 56.

A cable anchor member 264 is secured to the discharge tube member 68 and includes an anchor section 266 having a sleeve connector clamp 268 integral therewith. An anchor bolt 270 is operable to secure the sleeve connector clamp 268 about an outer end of the outer sleeve 256 of the cable member 246.

It is obvious that pivotal movement of the handle member 244 would operate to axially move the inner cable 254 which, in turn, would pivot the cable connector 262 and interconnected baffle member 258 to adjustably control air flow through the discharge tube member 68 of the main blower assembly 56.

USE AND OPERATION OF THE INVENTION

In the use and operation of the universal bag spreader apparatus 12 of this invention as noted in FIG. 1, the baked goods production system 14 is operable to bake and initially package a baked product 16 in a container member 18 within the baking and packaging assembly 20.

The container member 18 as initially coming out of the baking and packaging assembly 20 contains a lot of air therein as shown by an expanded open end 19.

The bagged food product is moved along a support portion of the continuous conveyor assembly 22 to a position as shown by the fourth container member 18 from the right which is in position to be acted on by the universal bag spreader apparatus 12.

On setting up use of the universal bag spreader apparatus 12, it is placed at a desired locational position along the continuous conveyor assembly 22 and, preferably, just before the bag preparation brush assembly 24 prior to the the next process step involving a bag closing assembly (not shown) whereupon a container member 18 will have the open bag end thereof secured by a clip member, a tie member, or other such fastening means.

The primary object of the universal bag spreader apparatus 12 of this invention is to utilize air flow to place the open bag end of the container member 18 in the best condition for subsequent operation through the bag closing assembly which is spread out and flattened to a minimum height.

Another objective of this invention is to place the discharge nozzle 118 at a proper position relative to the passing of the container members 18 with the baked product 16 therein. Various ones of the discharge nozzles 118 can be selected having a desired shape and size of the discharge opening 119 depending on the size of the container member 18 and type of material from which it is constructed.

A first step is to move the horizontal support arm assembly 124 and, more specifically, the bracket member 130 vertically as noted by arrow 272 on loosening the wing bolt 138 in the support collar 132. On reaching a selected height of the bracket member 130 indicated by alignment of an indicator line 117 with an upper surface of the support collar 132, the wing bolt 138 is tightened to place an inner end thereof into a now aligned groove 115. The interaction of the wing bolt 138 into the groove 115 provides a lock feature to prevent non-intentional downward movement of the horizontal support arm assembly.

Prior to locking of the horizontal support arm assembly 124, the bracket member 130 through the support collar 132 can be rotated as noted by arrow 274 as necessary on the vertical tube member 104 to achieve the desired axial direction of the bracket member 130 from the vertical tube member 104.

As noted in FIG. 6, an outward position of the discharge nozzle 118 relative to the vertical tube member 104 can be adjusted through use of the yoke support bracket assembly 126 which is axially movable on the bracket member 130 as noted by arrow 276. On reaching a desired axial location, the connector wing nut and bolt member 144 can be tightened to secure the arm support tube member 142 to the bracket member 130 as noted in FIG. 6.

Next, an angular direction of the discharge nozzle assembly 110 can be adjusted by rotational movement of the main yoke member 158 about the yoke connector assembly 160 as shown by arrow 277. A resistance to rotational movement of the main yoke member 158 is achieved by the yoke connector assembly 160 and, more specifically, by the sandwiched neoprene washers 176 between the washer members 174. The amount of resistance to rotational movement is adjustable by rotation of the lock nut member 180 on the main support bolt 170.

On referring to FIG. 7, the discharge tube member 116 is rotatable as noted by arrow 288 through the air tube connector assembly 188 to adjust the air discharge angle from the discharge nozzle 118.

The adjustable tube brake assembly 186 adds resistance to rotation of the discharge tube member 116 to hold in an adjusted position. This resistance or braking force can be adjusted through the clamp ring 210 and rotation of the connector wing nut and bolt 212.

The final discharge assembly 92 and the discharge nozzle 118 can be pivoted vertically about a horizontal axis as noted by arrow 290. This is achieved through use of the tube pivot support assembly 184 with the subject horizontal axis being that of the aligned support handle members 192. The spacer members 202 can be grasped to pivot the discharge tube member 116 and the adjustment nut members 204 can be tightened on the support handle members 192 to hold in an adjusted position.

Lubrication is available through the grease zerks 196 and 216 to permit ease of rotation of the discharge tube member 116 relative to the stationary main bearing member 190 and the connector sleeve member 214 of the air tube connector assembly 188.

Next, on reaching the final vertical, lateral, and rotational adjustments to place the discharge nozzle 118 in a precision relationship to the container member 18 having the baked product 16 therein, the main control assembly 32 can be utilized through control buttons 234 to energize the power blower assembly 38 and, more specifically, to energize the main blower assembly 56.

This pulls intake air through the air filter members 78 of the inlet air filter assembly 40 to supply inlet pressure air through the inlet hose member 72 to the discharge tube member 68. This filter, pressure air is conveyed through the primary inlet assembly 88, the intermediate inlet assembly 90, and the final discharge assembly 92 for subsequent discharge through the discharge nozzle 118.

The large size of the air filter members 78 provides for inlet air to enter in an unrestricted manner for conveyance through the inlet hose member 72 into the main blower assembly 56 without any back pressure. The use of the paddle wheel assembly 64 as a source of air supply has proven very effective in achieving a large volume of air flow therethrough.

At this point, it is obvious that the main control assembly 32 and, more specifically, the air flow control assembly 226, can be operated as noted in FIG. 5 to control the volume of air flow through the dicharge tube member 68 into the primary inlet assembly 88.

More specifically, the cable member 254 can be operable through the handle member 244 as noted by arrow 284 in order to move the baffle member 258 with its pivot shaft 260 as noted by arrow 286 to various angles within the inner cavity of the discharge tube member 68. This movement of the baffle member 258 will tend to increase or decrease the size of an air flow channel within the discharge tube member 68 to precisely control the air flow which is an important adjustment feature of this invention.

It is obvious from the invention that the motor and blower assembly 44 could be mounted in an out-of-the-way location, provided with soundproofing if so desired, and still convey the air achieved therefrom through a flexible inlet hose member 72 to be connected to the primary inlet assembly 88 or conveyance tube member 98 to supply the necessary air flow thereto. Additionally, the power control assembly 224 could be mounted in a different remote location if so desired.

The universal bag spreader apparatus of this invention provides a means of achieving an adjustable air flow and volume which can be directed through a discharge nozzle in a precise manner against the top and open end of a container member operable to 1) first contact and drive out any air contained with the container member through the open end thereof; and 2) force an outer open end of the air evacuated container member into a flattened condition for a subsequent bag closing operation, thus placing in the best condition for attaching a clip member and tie member thereto.

The universal bag spreader apparatus of this invention is compact in construction; economical to operate; fully adjustable in placing a discharge nozzle relative to a container member provided with an inlet air filter assembly to assure that only cleansed air is directed toward the baked product within a container member; and substantially maintenance free.

While the invention has been described in conjunction with preferred specific embodiments thereof, it will be understood this description is intended to illustrate and not to limit the scope of the invention, which is defined by the following claims:

I claim:

1. A universal bag spreader apparatus adapted to direct a pressure air flow toward an open end of a container member having goods therein for the purpose of removing air plus spreading and flattening the open end of the container member, comprising:

a) a blower means for creating a pressure air flow;

b) a vertical tube member connected to the pressure air flow and having a final discharge assembly with a discharge nozzle connected by a connector member to an air output from said vertical tube member for exit of the pressure air flow through the discharge nozzle; and c) an adjustable air discharge assembly connected to said vertical tube member and said final discharge assembly permitting adjustment of said discharge nozzle to an infinite number of positions relative to a longitudinal axis of said vertical tube member with movement in vertical, lateral, radial, and rotational directions.

2. A universal bag spreader apparatus as described in claim 1, wherein:

a) said connector member is rotatable 360 degrees to rotate said final discharge assembly about said vertical tube member.

3. A universal bag spreader apparatus as described in claim 1, wherein:

a) said adjustable air discharge assembly includes an adjustable support arm assembly having a horizontal support arm assembly connected to said vertical tube member and pivotal laterally thereabout and movable vertically thereon.

4. A universal bag spreader apparatus as described in claim 3, wherein:

a) said horizontal support arm assembly includes a bracket member having a support collar rotatably mounted on said vertical tube member and having a yoke support bracket assembly mounted on said bracket member for axial movement thereon and lockable in a selected axial position along said bracket member.

5. A universal bag spreader apparatus as described in claim 4, wherein:

a) said adjustable support arm assembly includes a support discharge tube assembly connected to said horizontal support arm assembly and to said final discharge assembly for pivotal movement about a vertical axis on said yoke support bracket assembly.

6. A universal bag spreader apparatus as described in claim 5, wherein:

a) said support discharge tube assembly includes a pivot yoke assembly mounted for rotational movement about a vertical axis on said yoke support bracket assembly and having a discharge tube pivot support and brake assembly pivotally connected to said pivot yoke assembly and said final discharge assembly for movement of said discharge nozzle about a horizontal axis and rotatable relative to said discharge tube pivot support and brake assembly.

7. A universal bag spreader apparatus as described in claim 6, wherein:

a) said pivot yoke assembly includes a main yoke member connected by a yoke connector assembly to said yoke support bracket assembly;

b) said yoke connector assembly includes a bolt member secured to said yoke support bracket assembly, alternating washer members, and neoprene washer members mounted between said bolt member and said main yoke member and having a lock nut thereon to provide a resilient friction brake thereto;

whereby said main yoke member is held in a given adjustable rotational position due to the frictional force against rotation exerted through said yoke connector assembly.

8. A universal bag spreader apparatus as described in claim 6, wherein:

a) said discharge tube pivot support and brake assembly includes a tube pivot support assembly secured to upper ends of said main yoke member and a tube brake assembly connected to said tube pivot support assembly and operably connected to said final discharge assembly to provide a brake to rotational movement of the discharge nozzle and to hold same in a given rotationally adjusted position.

9. A universal bag spreader apparatus as described in claim 8, wherein:

a) said discharge pivot tube support and brake assembly includes an air tube connector assembly connected to said tube brake assembly for non-rotational movement and encloses a portion of said final discharge assembly while permitting rotational movement of said discharge nozzle.

10. A universal bag spreader apparatus used in a production system to apply air pressure against a container member to spread and flatten an open end of said container member, comprising:

a) a main blower and filter assembly to provide an air flow under pressure;

b) an adjustable air discharge assembly connected to said main blower and filter assembly to receive the air flow and direct same to a final discharge assembly for discharge through a discharge nozzle;

c) said adjustable air discharge assembly includes an intermediate inlet assembly having a tube member and an adjustable support arm assembly adjustably connected to said tube member for vertical, lateral, and horizontal movements; and d) said adjustable support arm assembly includes a support discharge tube assembly connected to said final discharge assembly to allow adjustable movement of said discharge nozzle vertically, laterally, and rotationally to an infinite number of adjusted positions.

11. A universal bag spreader apparatus as described in claim 10, wherein:

a) said main blower and filter assembly includes a main blower assembly connected to an air filter assembly operable to receive inlet air flow through a plurality of spaced air filter members having a large filter area for directing the inlet air into a main blower assembly for conveyance to said adjustable air discharge assembly; and b) said main blower assembly connected by a discharge member to said adjustable air discharge assembly.

12. A universal bag spreader apparatus as described in claim 11, including:

a) a main control assembly having an air flow control assembly connected to said discharge member having means therein to selectively increase and decrease air flow to said adjustable air discharge assembly to regulate the volume of air flow therethrough.

13. A universal bag spreader apparatus as described in claim 10, wherein:

a) said adjustable air discharge assembly includes an adjustable support arm assembly having a horizontal support arm assembly pivotally connected and vertically adjustable to said intermediate inlet assembly; a yoke support bracket assembly secured to said horizontal support arm assembly for axial adjustable movement thereon; and a support discharge tube assembly connected between said yoke support bracket assembly and said final discharge assembly allowing pivotal adjustable movement about a vertical axis, a horizontal axis, and rotatable about a longitudinal axis of said final discharge assembly.

14. In a baked goods production system, including a bakery and packaging assembly supplying a baked food product in an open ended container member moving on a continuous conveyor assembly toward a bag closing assembly, the improvement being a universal bag spreader apparatus to spread and flatten the open end of the container member before entering the bag closing assembly, comprising:

a) a main blower assembly to receive inlet air to create a pressurized output air flow;

b) an adjustable air discharge assembly connected to said main blower assembly to direct the output air flow through a primary inlet assembly, an intermediate inlet assembly, and a final discharge assembly for exit through a discharge nozzle;

c) said adjustable air discharge assembly includes a horizontal support arm assembly adjustably connected for vertical and lateral movement relative to said intermediate inlet assembly, a yoke support bracket assembly mounted on said horizontal support arm assembly for adjustable, horizontal and lateral movement, and a support discharge tube assembly connected between said yoke support bracket assembly and said final discharge assembly for adjustable rotational movement of said discharge nozzle about a vertical axis plus rotational and pivotal movement about a horizontal axis.

15. A universal bag spreader apparatus as described in claim 14, wherein:

a) said primary inlet assembly includes an inlet opening connected to said main blower assembly to receive inlet air thereto to direct same to said intermediate inlet assembly;

b) said intermediate inlet assembly includes a vertical tube member with a rotatable swivel connector member at an upper end connected to said final discharge assembly for adjustable 360 degree rotational movement; and c) said final discharge assembly includes a flexible hose member connected at one end to said swivel connector member and at the opposite end to a discharge tube member having said discharge nozzle connected to an outer end thereof.

16. A universal bag spreader apparatus as described in claim 15, wherein:

a) said horizontal support arm assembly is connected to said vertical tube;

b) said support discharge tube assembly includes a pivot yoke assembly pivotally connected to said yoke support bracket assembly for rotatable movement about a vertical axis and having a discharge tube pivot support and brake assembly connected to an upper end of said pivot yoke assembly and to said final discharge assembly; and c) said discharge pivot tube support and brake assembly includes a tube pivot support assembly having handle members pivotally connected to said main pivot yoke assembly and a main bearing member mounted about the discharge tube member allowing for rotational but not axial movement thereof.

17. A universal bag spreader apparatus as described in claim 16, wherein:

a) said discharge pivot tube support and brake assembly includes a tube brake assembly connected to said tube pivot support assembly and operable to provide a clamping braking action about said discharge tube member to provide resistance to rotational movement and hold said discharge tube member in a given adjusted rotated position.

18. A universal bag spreader apparatus as described in claim 17, wherein:

a) said discharge pivot tube support and brake assembly includes an air tube connector assembly having a connector sleeve member connected to said swivel connector member and said discharge tube member to allow rotational but not axial movement thereof.

19. A universal bag spreader apparatus as described in claim 18, wherein:

a) said air tube connector assembly includes lubrication means to apply lubrication material to said connector sleeve member and said discharge tube member.

20. A universal bag spreader apparatus as described in claim 15, wherein:

a) said final discharge assembly includes a swivel elbow member connected to said opposite end of said flexible hose member and to said discharge tube member for adjustable 360 degree rotational movement.

* * * * *